US009200420B2

(12) United States Patent
Bramlett

(10) Patent No.: US 9,200,420 B2
(45) Date of Patent: Dec. 1, 2015

(54) PNEUMATIC TRACTION ENHANCER FOR RAILCAR MOVER

(71) Applicant: NORDCO INC., Oak Creek, WI (US)

(72) Inventor: Pat Bramlett, Overland Park, KS (US)

(73) Assignee: Nordco Inc., Oak Creek, WI (US)

( * ) Notice: Subject to any disclaimer, the term of this patent is extended or adjusted under 35 U.S.C. 154(b) by 178 days.

(21) Appl. No.: 14/010,026

(22) Filed: Aug. 26, 2013

(65) Prior Publication Data

US 2015/0053109 A1 Feb. 26, 2015

(51) Int. Cl.

| | |
|---|---|
| ***E01H 8/10*** | (2006.01) |
| ***E01H 1/08*** | (2006.01) |
| ***E01H 8/00*** | (2006.01) |

(52) U.S. Cl.

CPC ..... *E01H 8/105* (2013.01); *E01H 1/0809* (2013.01); *E01H 8/00* (2013.01)

(58) Field of Classification Search

CPC ..... E01H 8/00; E01H 8/10; E01H 8/105; E01H 1/0809

USPC ..... 104/279

See application file for complete search history.

(56) References Cited

U.S. PATENT DOCUMENTS

| | | | | |
|---|---|---|---|---|
| 440,690 | A | 11/1890 | Bevin | |
| 490,269 | A | 1/1893 | Chisholm | |
| 893,878 | A | 7/1908 | Shires | |
| 1,824,067 | A | 9/1931 | Becker | |
| 2,597,719 | A | 5/1952 | Foster | |
| 3,680,885 | A | 8/1972 | DeCardi et al. | |
| 4,023,286 | A | 5/1977 | Wickware | |
| 4,063,606 | A | 12/1977 | Makinson | |
| 4,230,045 | A | 10/1980 | Fearon | |
| 4,324,307 | A | 4/1982 | Schittino et al. | |
| 4,781,121 | A | 11/1988 | Kumar et al. | |
| 4,789,190 | A | 12/1988 | Eike et al. | |
| 4,834,320 | A | 5/1989 | Tyson | |
| 4,848,510 | A | 7/1989 | Ahmed | |
| 5,236,063 | A * | 8/1993 | Nelson et al. | 184/3.2 |
| 5,350,035 | A | 9/1994 | Bodier et al. | |
| 6,148,732 | A * | 11/2000 | Conway et al. | 104/279 |
| 6,488,217 | B1 | 12/2002 | Donastorg | |
| 6,848,726 | B1 | 2/2005 | Horsham | |
| 6,893,058 | B2 | 5/2005 | Kumar et al. | |
| 6,946,621 | B1 | 9/2005 | Roseman | |
| 7,290,807 | B2 | 11/2007 | Kumar | |
| 7,594,682 | B2 | 9/2009 | Kumar et al. | |
| 2003/0079640 | A1 * | 5/2003 | Beatson et al. | 104/106 |
| 2012/0061367 | A1 | 3/2012 | Wolff et al. | |

* cited by examiner

*Primary Examiner* — Zachary Kuhfuss

(74) *Attorney, Agent, or Firm* — Greer, Burns & Crain, Ltd.

(57) ABSTRACT

A railcar mover is provided that is configured for use on a railroad track and has a frame, a plurality of traction wheels, and a traction enhancing system. Included in the traction enhancing system is an air nozzle associated with at least one of the traction wheels, mounted directly or indirectly relative to the frame so that an outlet of the air nozzle is directed at a corresponding rail of the railroad track for emitting high pressure air for removing at least one of unwanted debris and moisture. In addition, a scraper blade is associated with the nozzle and mounted relative to the nozzle so that the scraper blade contacts debris on the track before the high pressure air, in a direction of travel of the mover.

13 Claims, 8 Drawing Sheets

PNEUMATIC TRACTION ENHANCER FOR RAILCAR MOVER

BACKGROUND

The present invention relates generally to traction systems for automotive movers, and more specifically to such a system provided to rail movers or railcar movers for enhancing traction of mover drive wheels when traveling on railroad track in unfavorable weather or track conditions.

Railcar movers are self-propelled machines used in rail yards for switching operations, i.e., moving individual rail cars, or connected strings of cars around the yard as needed to unload cargo and for assembling trains. Railcar movers are provided with large displacement engines for providing significant pushing or pulling power, preferably in the range of 15,000 to 60,000 pounds of traction effort, and often have large drive wheels, either steel rail wheels or industrial rubber-tired wheels, the latter also suitable for road travel or travel within the rail yard off of the railroad track, for moving from one track to another. Rubber-tired wheels, also referred to as rubber tires, provide a higher coefficient of friction on the rail compared with conventional steel rail wheels of the type found on locomotives. This higher coefficient of friction increases the pulling capacity of a given railcar mover.

In addition, railcar movers have rail wheels which are retracted until the mover is properly aligned on the track for pulling or pushing rail cars as needed. At that time, the rail wheels are lowered into engagement with the track under operator control. However, the rail wheels provide only a guiding function, since the propulsion of the railcar mover is achieved by engagement of the drive wheels with the rail head. At each end of the railcar mover is a standard rail coupler which enables the mover to connect or disconnect with selected rail cars under operator control from within an operators cab located on the mover or remotely.

One drawback of rubber tires is that during inclement weather, when the track is wet, or covered with ice or snow, or when there is excessive debris on the rails, such as spilled cargo or recently mowed vegetation, the rubber tires more easily lose traction and slip on the rails. This slippage reduces pulling power and overall operational efficiency of the railcar mover.

Conventionally, this problem has been addressed by providing the railcar mover with a bi-directional sanding system, which distributes sand upon the rail just behind or just ahead of the drive wheels, depending on the direction of travel. However, in practice, sanding units have not proven satisfactory. Accordingly, there is a need for a railcar mover with an enhanced traction system that improves traction when track conditions are slippery.

SUMMARY

The above-identified need is met by the present traction enhancing system configured for use with a railcar mover for removing unwanted moisture and/or debris from the rails in advance of contact by the drive wheels of the rail mover. Included in the system is a high velocity nozzle that dispenses pressurized air upon an upper surface of the rail. Preferably, the nozzle is a Laval-type nozzle dispensing pressurized air at approximately 120 psi and having an outlet located in close proximity to the rail surface. In addition, in advance of the nozzle, the system employs a scraper or squeegee for removing larger pieces of debris or accumulated snow prior to exposure of the rail surface to the pressurized air of the nozzle. Another feature of the present system is that the nozzle and scraper are mounted to a retractable rail guide wheel, so that when the mover is not running on the track, the system is retracted with the rail guide wheels to avoid impact damage during transport. Use of the present system has significantly improved traction of rail movers on otherwise wet, snow-covered or debris-laden rails, even over conventional sanding systems.

The present system is configured for using the existing railcar mover pneumatic system to provide compressed air to the nozzle at the rail to remove the majority of water or snow. A nozzle was selected that provides sufficient velocity without unduly taxing the mover's pneumatic system, which is also used to operate brakes and other components. In the preferred embodiment, the system includes a designated compressed air reservoir and a check valve for preventing the air knife system from drawing compressed air from the mover's pneumatic system once the reservoir is empty. This system is not designed to dry the rail completely, but rather get rid of most of the moisture.

The present traction enhancing system is designed to limit the amount of lost traction by railcar movers when faced with wet or snow-covered rails. On dry track, the rubber tires have a 0.80 coefficient of friction (cof) with the rail. When the rail is wet, the coefficient of friction lessens substantially. It is estimated that, wet rail and conventional railcar mover tires have a cof of as low as 0.20. The cof on snow-covered rail is estimated to be even lower.

More specifically, a railcar mover is provided that is configured for use on a railroad track and having a frame, a plurality of drive or traction wheels, and a traction enhancing system. Included in the traction enhancing system is an air nozzle associated with the drive rail guide wheels, mounted directly or indirectly relative to the frame so that an outlet of the air nozzle is directed at a corresponding rail of the railroad track for emitting high pressure air for removing at least one of unwanted debris and moisture. In addition, a scraper blade is associated with the nozzle and mounted relative to the nozzle so that the scraper blade contacts debris on the track before the high pressure air, in a direction of travel of the mover.

In another embodiment, a railcar mover is provided that is configured for use on rails of a railroad track, and includes a frame, a plurality of rubber-tired traction or drive wheels connected to the frame, at least one set of retractable rail guide wheels operatively associated with the frame and a traction enhancing system. The traction enhancing system includes an air nozzle associated with at least one of the rubber-tired or rail guide wheels, mounted to a bracket connected to an associated one of the rail guide wheels for common movement relative to the track between a working and a retracted position. An outlet of the air nozzle is directed at a selected angle relative to vertical for emitting high pressure air at approximately 120 psi for removing at least one of unwanted debris and moisture from the rail. A scraper blade is associated with the nozzle and is mounted relative to the nozzle for common movement with the associated rail guide wheel so that the scraper blade contacts debris on the track before the high pressure air, in a direction of travel of the mover.

DETAILED DESCRIPTION

Figure 1:
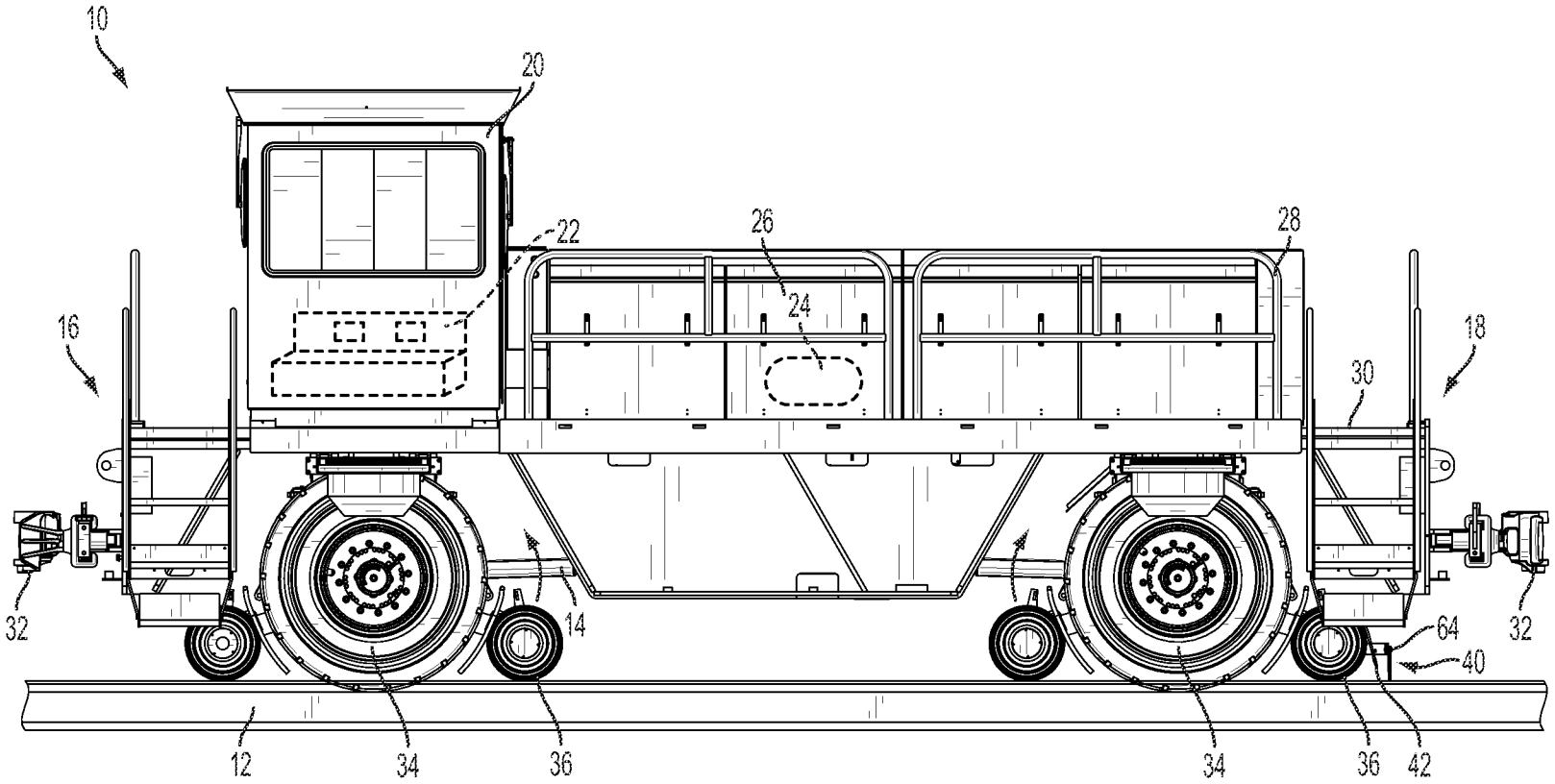
FIG. 1 is a side elevational view of the present railcar mover, equipped with the present traction enhancing system.
Figure 2:
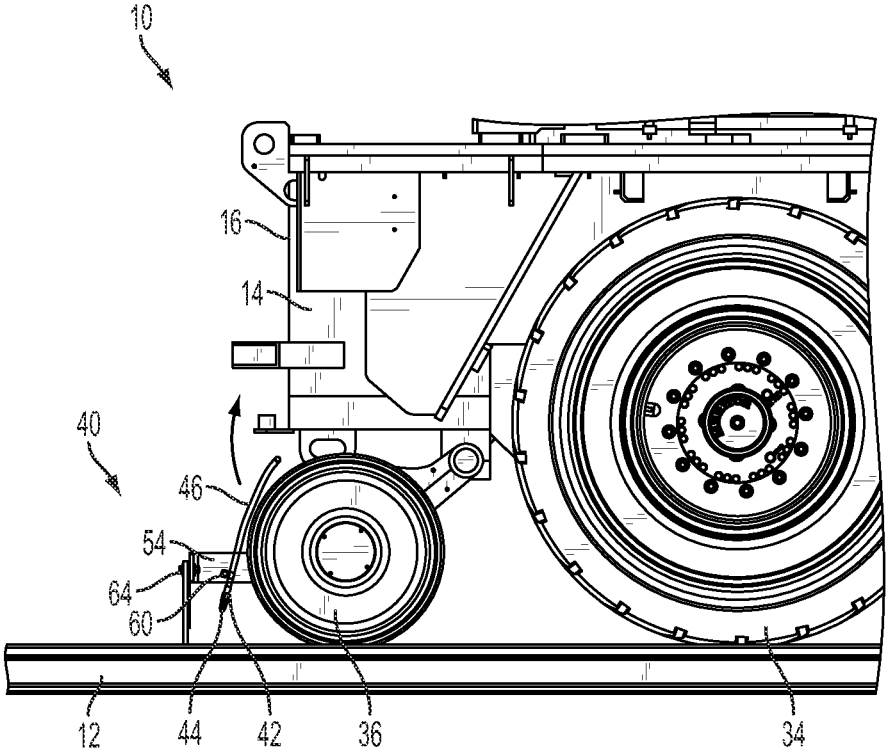
FIG. 2 is a fragmentary side elevation of a rail mover of equipped with the present traction enhancing system.
Figure 3:
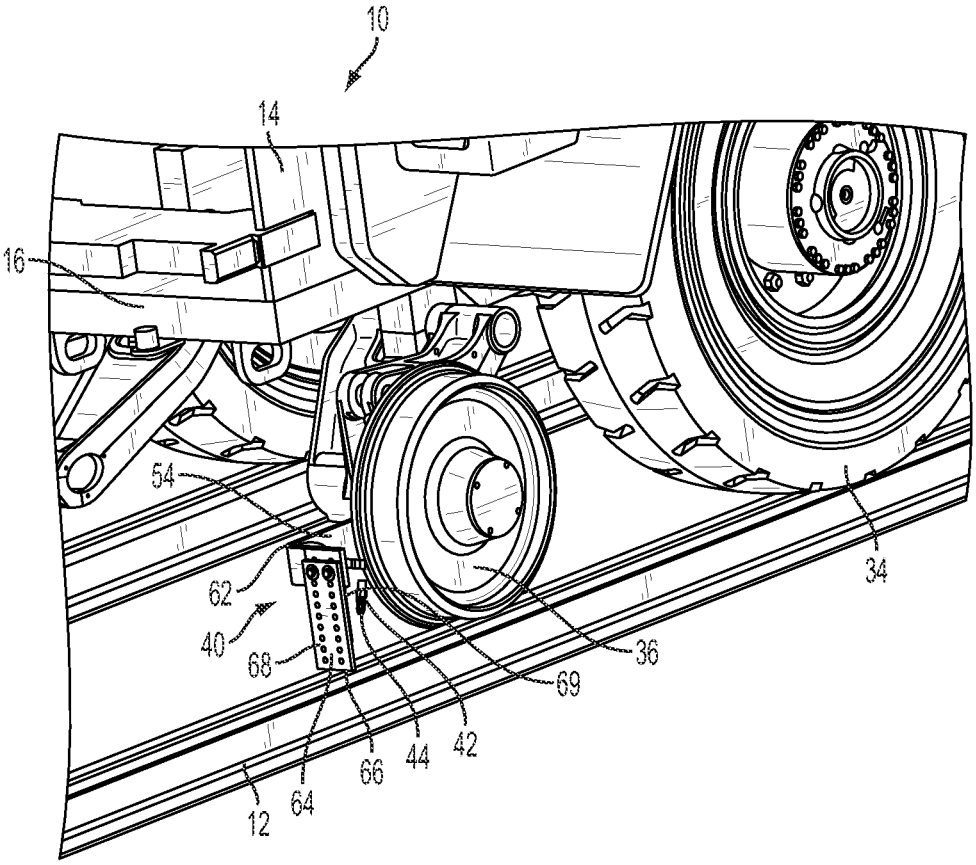
FIG. 3 is a fragmentary top perspective view of the rail car mover of FIG. 2.
Figure 4:
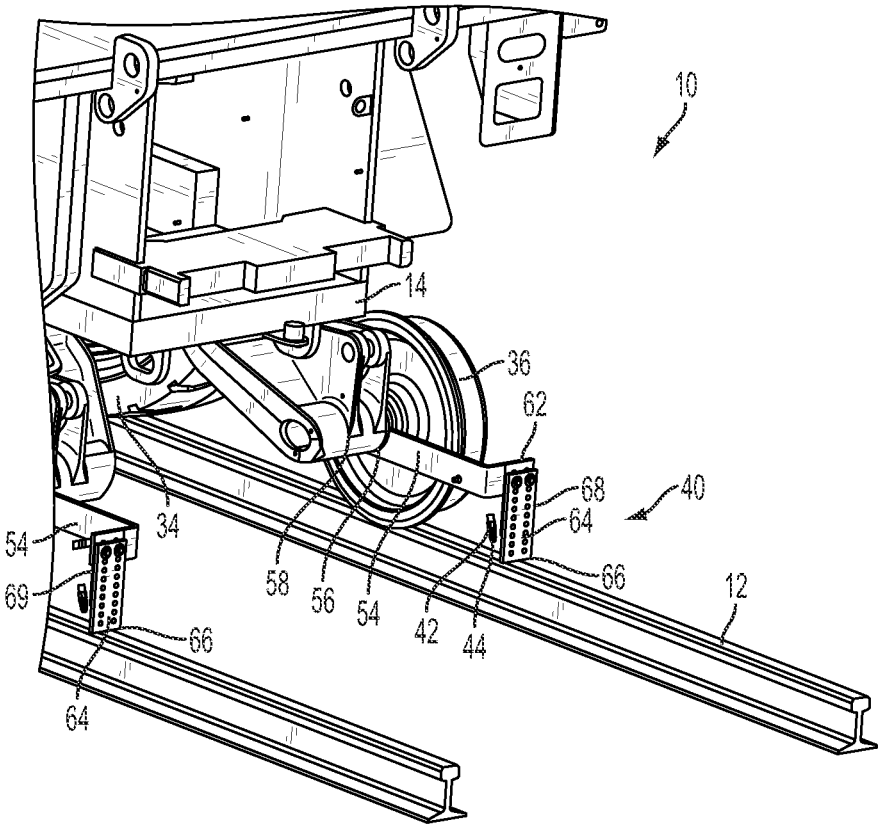
FIG. 4 is a fragmentary top perspective view of the rail car mover of FIG. 3 from an opposite side.

Referring now to FIG. 1, a rail car mover constructed in accordance with the present invention is generally designated 10 and is used in railcar sidings and the like to move railcars along conventional railroad track rails 12. Such movers are described in greater detail in U.S. patent application Ser. No. 13/473,217, which is incorporated by reference. The mover 10 has a frame 14 with a front end 16 and a rear end 18. A cab 20 is included on the mover 10 for accommodating an operator (not shown). A control system 22, shown schematically and hidden, exists for operating the mover 10, preferably inside the cab 20. A conventional internal combustion engine 24 (shown hidden), preferably a diesel engine, is associated with the frame 14 and is covered by a housing 26. Guard rails 28 are provided on an access platform 30 generally extending around a periphery of the housing 26. Conventional rail car couplers 32 are provided at the front and rear ends 16 and 18, respectively, of the mover frame 14 for selective coupling with railcars as is well known in the art. Also as is known in the railcar mover art, once a railcar is coupled to the mover 10 using the coupler 32, an additional connection is made between a pneumatic system of the mover 10 and the internal pneumatic system of the rail car. Since the pneumatic rail car system operates the rail car brakes, it is more effective for the mover 10 to be in control of the rail car brakes during manipulation of the rail car in the rail yard. The use of the rail car pneumatic system is a factor in the present traction enhancing system.

Also included on the mover is at least one and preferably four drive or traction wheels 34, at least two of which are connected, directly or indirectly, to the engine 24 for providing driving force, whether on road or on the railroad track 12. As stated above, while the drive wheels are typically steel or rubber-tired, an advantage of rubber tires 34 is enhanced traction on rails compared to conventional steel rail drive wheels. However a drawback of such rubber tires is that traction is reduced or lost when the rails are wet or debris-covered.

In addition to the drive wheels 34, the mover 10 is provided with at least one, and preferably a plurality of sets of rail guide wheels 36. Guide wheels 36 are typically provided to movers with rubber tires on the traction wheels 34. In the preferred embodiment, there are two rail guide wheels 36 for each drive wheel 34, but that arrangement may vary to suit the situation. Further, as is known in the art, the rail guide wheels 36 are movable between a lowered, operational position where they are in engagement with the rails 12 as shown in FIG. 1, and a retracted position in the direction of the curved arrows where they are raised automatically under operator control so that they are free of engagement with the rails.

Referring now to FIGS. 2-4 and 8, a feature of the present mover 10 is that it is equipped with a pneumatic traction enhancing system, generally designated 40, which includes an air nozzle 42 associated with at least one of the drive or rail guide wheels 34, 36, and is mounted directly or indirectly relative to the frame 14 so that an outlet 44 of the air nozzle is directed at a corresponding rail 12 of the railroad track for emitting high pressure air for removing at least one of unwanted debris and moisture. As shown, there is a nozzle 42 associated with each of the drive wheels 34, but the number and placement of nozzles may vary to suit the situation. In the preferred embodiment, there are two nozzles 42 in the front of the mover 10 for forward motion, and two nozzles in the rear of the mover for reverse motion.

In the preferred embodiment, the nozzle 42 is a Laval nozzle capable of operating at least at 120 psi with the existing pneumatic system of the mover 10, and delivering pressurized air at a velocity in the range of 800-1200 ft/sec. The preferred nozzle 42 consumed 16.0 scfm at 120 psi, and generated 830 fps air velocity measured at 2" and 80 psi with a 1.57" diameter cone measured at 2 inches. It was found that nozzles emitting high velocity were superior in rail clearing over nozzles emitting high pressure or force. A preferred nozzle 42 is provided by Silvent North America, LLC, Portage, Ind. A supply hose 46 (FIG. 2) fluidly connects the nozzle 42 to a dedicated pressurized air reservoir 48 (FIG. 8) which is connected to a main mover pressurized air reservoir 50. The latter reservoir is supplied by a compressor 52 ultimately powered by the engine 24 as is known in the art. The nozzles 42 are operated through the control system 22, using solenoid valves or the like.

Referring again to FIGS. 2-4, it is preferred that the nozzle 42 is connected to a support bracket 54 which is preferably "L"-shaped and connected at one end 56 to a spindle 58 of the associated rail guide wheel 36 (FIG. 4). A clamp 60 on the bracket 54 (FIG. 2) securely retains the hose 46, and thus the nozzle 42 in a desired position once the rail guide wheels 36 are placed in their operational position in contact with the rails 12 as shown. Preferably, the outlet 44 is spaced approximately 1 inch from an upper surface of the rail 12, and the nozzle 42 is oriented at approximately 15° relative to a vertical axis, however other placements are contemplated. It was found that the nozzle 42 leaning 15° degrees forward gave the best performance. This inclination allowed for better track drying at speed while keeping the air nozzle stream close to the rail.

A free end 62 of the bracket 54 is angled at an approximate right angle to a main bracket axis, and is preferably positioned transverse to a longitudinal axis of the rails 12. This generally planar end 62 is provided with elongate slots for accommodating fasteners used to mount a scraper blade 64 in a transverse, perpendicular orientation to the rail axis. It is preferred that a lower edge 66 of the blade 64 initially be in contact with an upper surface of the rail 12. Through use, abrasion and friction encountered during operation causes wear on the lower edge 66, eventually creating a space between the lower edge and the rail surface. However, the space does not impair the effectiveness of the scraper blade 64, since the main task of the blade is to remove large debris and accumulated snow.

It is preferred that the scraper blade 64 is made of a rigid, self-supporting material significantly strong to withstand impact with rail-borne debris, and also that the blade 64 is provided with a plurality of adjustment openings 68 for adjusting the vertical mounting height of the blade to suit the application. In this configuration, the air nozzle 42 and the scraper blade 64 are mounted together for common movement with an associated rail guide wheel 36. It is also contemplated that the blade 64 is provided with a vertically adjustable backplate 69 that provides adjustable rigidity to the blade. The lower the backplate 69 or closer to the edge 66, the less the blade 64 deflects.

Figure 5:
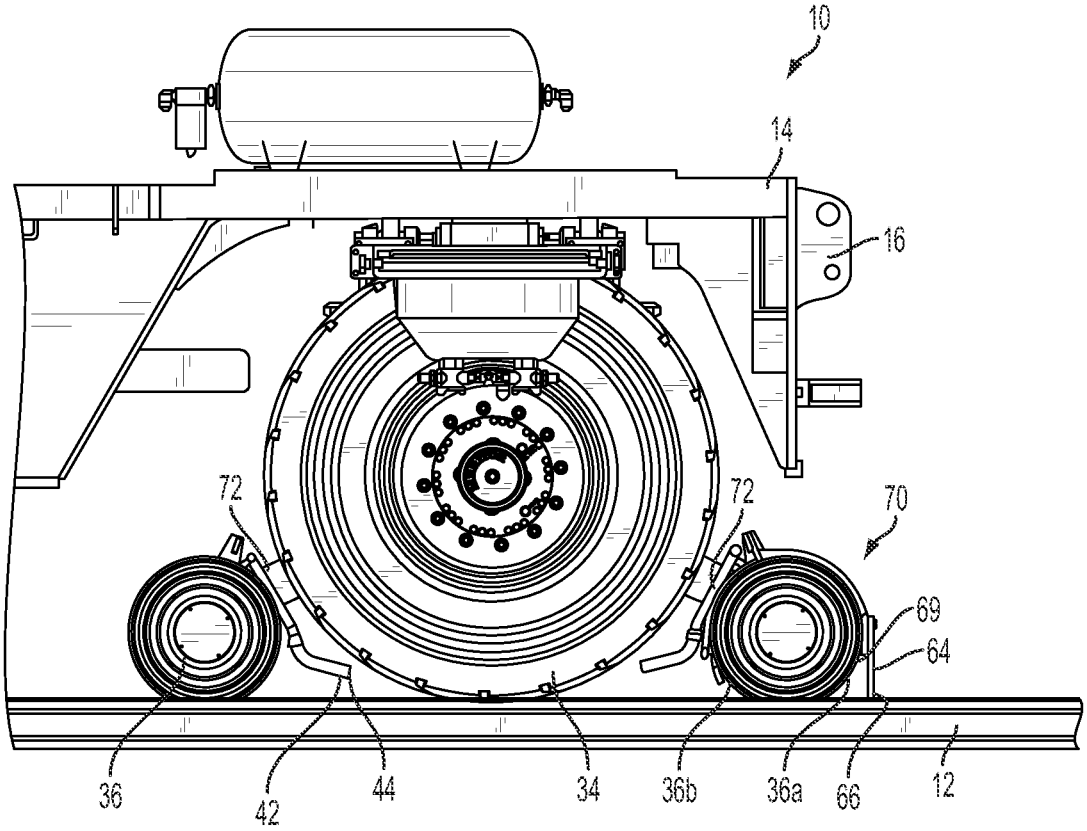
FIG. 5 is a fragmentary side elevation of an alternate embodiment of the present traction enhancement system.
Figure 6:
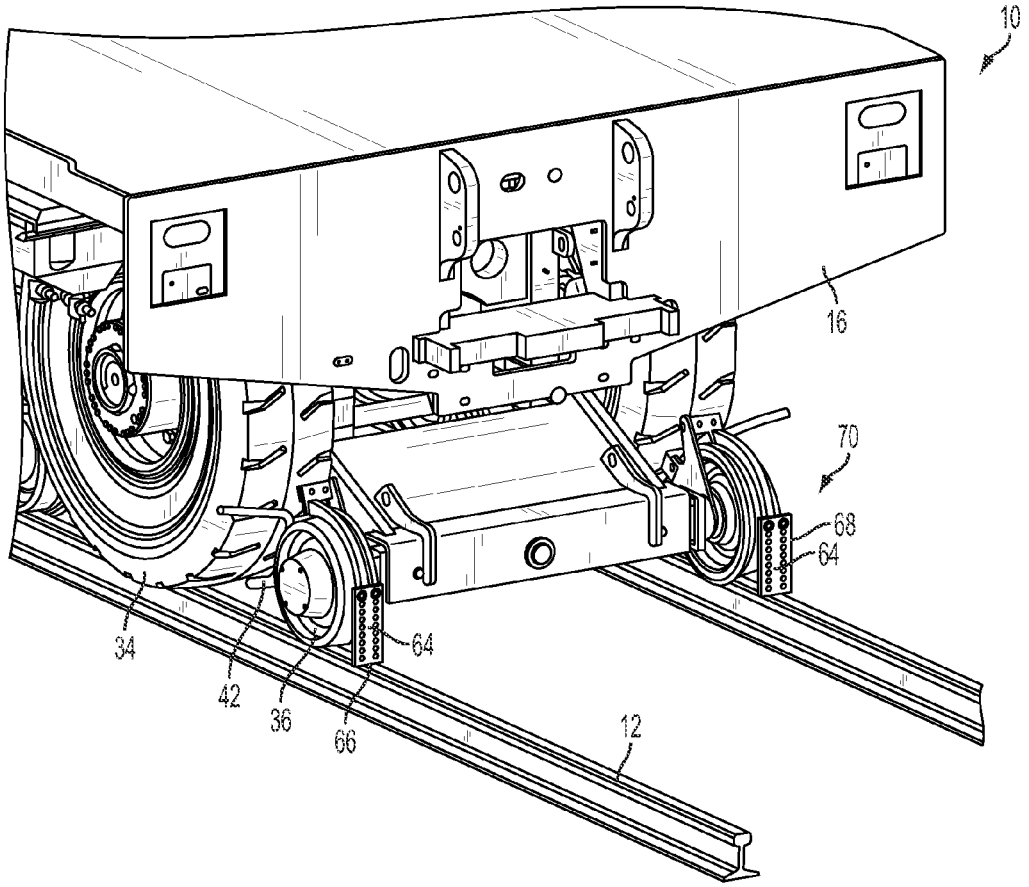
FIG. 6 is a fragmentary top perspective of view of the traction enhancement system of FIG. 5.

Referring now to FIGS. 5 and 6, another embodiment of the present traction enhancing system is depicted and generally designated 70. Features shared with the system 40 are identified with identical reference numbers. The main difference between the systems 40 and 70 is that in the latter, the scraper blade 64 and the nozzle 42 are on opposite sides of the rail guide wheel 36, while in the former, the nozzle and the scraper blade are on the same side of the rail guide wheel. In this context, the "side" of the wheel 36 refers to the edges of the wheel seen in the direction of travel of the mover 10 along the rails 12. In the system 70, the scraper blade 64 is located adjacent a first side 36*a*, and the nozzle is located adjacent a second side 36*b*.

Figure 7:
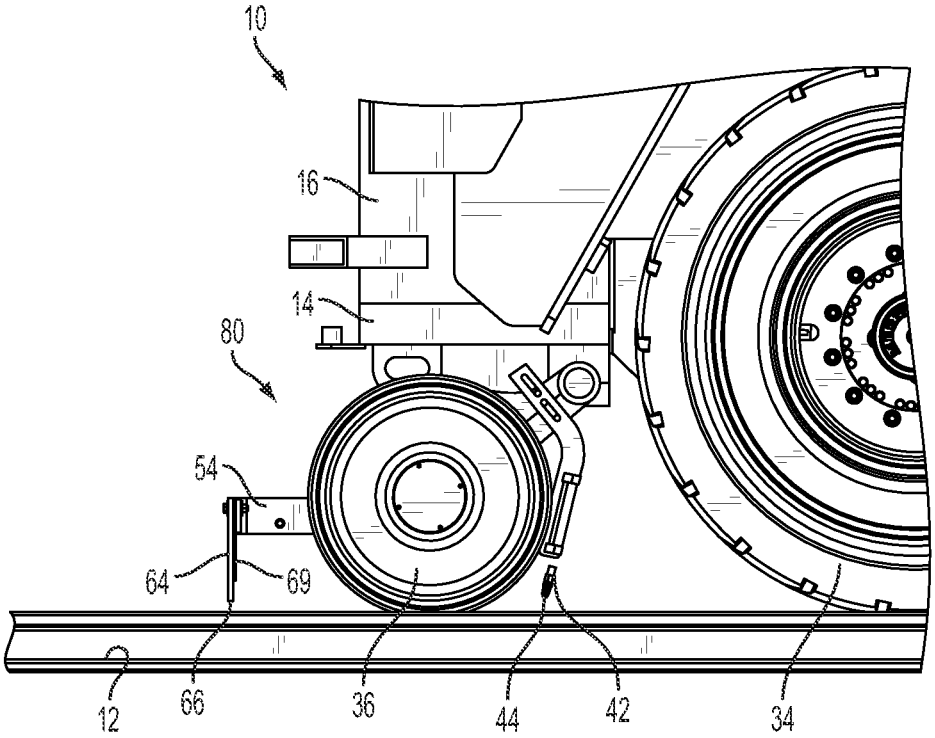
FIG. 7 is a fragmentary side elevation of another alternate embodiment of the present traction enhancement system.

To accomplish the mounting scenario of FIGS. 5-7, the nozzle 64 is provided with a designated nozzle bracket 72, which is also fixed to the spindle 58. The nozzle bracket 72 is preferably a separate component from the support bracket 54. Another difference between the systems 40 and 70 is that in the former, the nozzle outlet 44 points toward the rail guide wheel 36, and in the latter, the nozzle outlet points toward the drive wheel 34. However, the direction of the nozzle outlet 44 may vary to suit the situation, and/or the side of the drive wheel 34 to which the nozzle is mounted.

Referring now to FIG. 7, still another embodiment of the present traction enhancing system is generally designated 80. Components shared with the systems 40, 70 are identified with identical reference numbers. A main difference between the systems 70 and 80 is that the nozzle outlet 44 points toward the drive wheel 34 in the system 70, and toward the rail guide wheel 36 in the system 80.

Figure 8:
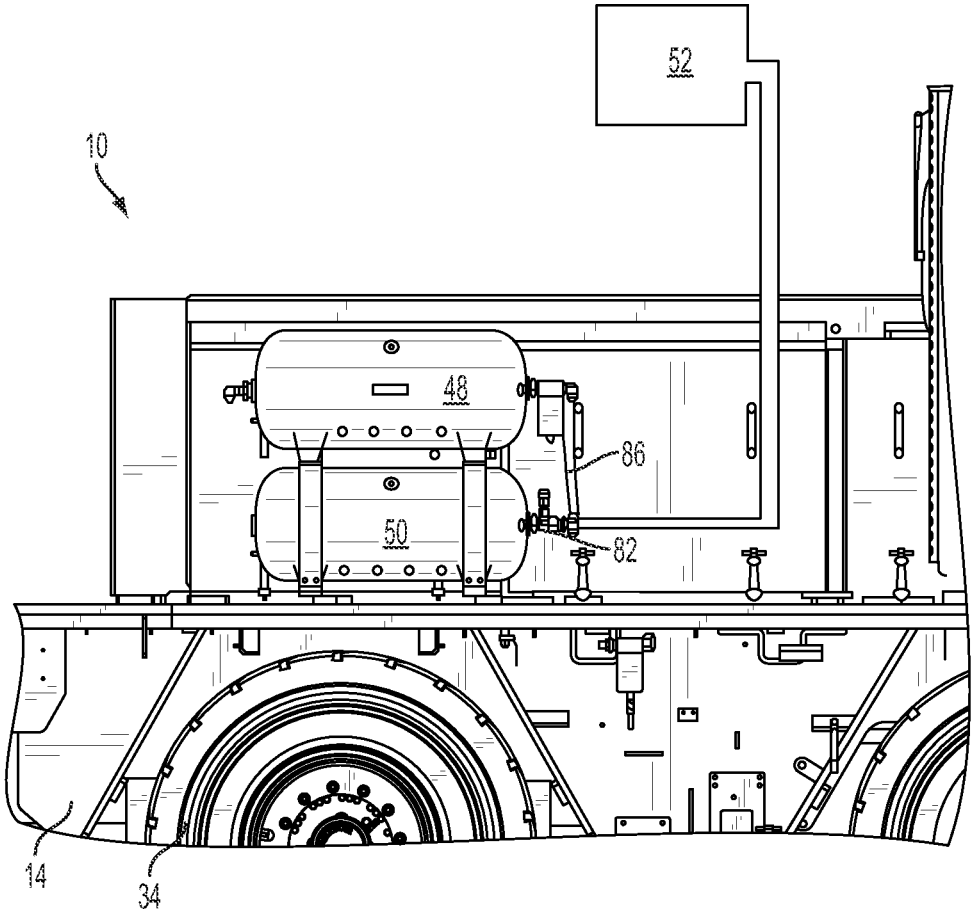
FIG. 8 is a fragmentary side elevation of the rail mover of FIG. 1 showing supplemental pressurized air reservoirs used in conjunction with the present traction enhancement system.

Referring now to FIG. 8, a partially schematic view of the pneumatic system of the mover 10 is shown. The compressor 52 supplies pressurized air to the main mover reservoir 50. The systems that use air on the mover 10 include a coupler release, an air horn, an optional air bell, air sanders, mover brakes, train brakes, a transmission differential lock, and air seats. The only system that uses a significant amount of air is the train brakes. Once the train brakes are charged, they should only require enough air supply to counteract the amount of leaking in the railcars. This can vary from site to site and is cumulative so the more cars that are moved, the more possibility of leaks.

If air consumption exceeds production, which typically occurs at low engine RPM and/or in the event of an air leak, the nozzle pressure will be reduced, also reducing the air velocity output, and thus the effectiveness of the nozzle 42, until an equilibrium of air input to output is achieved. A check valve 82 is installed on the main reservoir 50 so that air cannot flow from the main reservoir to the nozzle reservoir 48. This arrangement is preferred for avoiding the train car brakes from actuating if the nozzles 42 are accidentally left on. In the preferred embodiment, the reservoir 48 has a 30 gallon capacity, but that is variable to suit the situation. As long as the engine speed is kept above 1200 rpm under full load, the air compressor 52 should produce enough air to continuously power the nozzles 42. At engine idle, the compressor 52 supplies enough flow to maintain 60 psi on the air nozzles 42, which is a desired minimum pressure for the main air reservoir 50 during normal operation. In the event the main reservoir pressure drops below 60 psi, the control system 22 will generate a visual and/or audible warning to the operator, indicating that the nozzles 42 were left on. When fully charged, the reservoir 48 holds enough capacity to power the nozzles for 30 seconds before the preferred 60 psi minimum pressure check valve 82 closes.

During testing, improvements were noted when using the present system 40, 70, 80 in wet conditions. A load cell was installed in the coupler 32 of a conventional mover without the present system 40, 70, 80, and another mover with the system. The load cell was set to read pounds of force exerted by the mover on the load. In dry conditions, the conventional mover was able to generate 36,000 lbs of force. In wet conditions it generated 24,000 lbs of force due to slippage of the rubber tires on the rails 12. Using the mover 10 equipped with the system 40, 30,000 lbs of force were generated in wet conditions. In other tests, coefficient of friction (cof) is known on dry rail at 0.80. The tested cof using a conventional mover in wet conditions was 0.53 and the cof when using the mover 10 with the system 40 in wet conditions was 0.67.

While a particular embodiment of the present pneumatic traction enhancer for rail mover has been shown and described, it will be appreciated by those skilled in the art that changes and modifications may be made thereto without departing from the invention in its broader aspects and as set forth in the following claims.

What is claimed:

1. A railcar mover configured for use on a railroad track and having a frame, a plurality of traction wheels, and a traction enhancing system comprising:

an air nozzle associated with the traction wheels, mounted directly or indirectly relative to the frame so that an outlet of said air nozzle is directed at a corresponding rail of the railroad track for emitting high pressure air for removing at least one of unwanted debris and moisture;

a scraper blade associated with said nozzle and mounted relative to said nozzle so that said scraper blade contacts debris on the track before the high pressure air, in a direction of travel of the mover; and a supplemental reservoir for pressurized air in fluid communication with said nozzle, said supplemental reservoir is in fluid communication with a pneumatic system of the mover, and through the use of at least one check valve, air from said reservoir can be used for supplying air to the mover and/or to a connected rail car, but air from a main reservoir cannot be used to fill said supplemental reservoir.

2. The mover of claim 1 further including at least one set of retractable rail guide wheels, wherein said air nozzle and said scraper blade are mounted together for common movement with an associated one of said rail guide wheels.

3. The mover of claim 1 wherein said scraper blade is oriented generally perpendicularly to a longitudinal axis of the track.

4. The mover of claim 3 wherein said scraper blade is vertically adjustable relative to a retaining bracket.

5. The mover of claim 1 wherein said nozzle is oriented at a 15° angle relative to a vertical axis.

6. The mover of claim 1 wherein said nozzle is a Laval nozzle and is configured for emitting pressurized air at 120 psi.

7. The mover of claim 6 wherein an outlet of said nozzle is disposed approximately one inch from an upper surface of a rail of the track.

8. The mover of claim 1 further including at least one set of retractable rail guide wheels, wherein said nozzle and said scraper blade are mounted on one of the same side of the associated rail guide wheel, and opposite sides of the associated rail guide wheel.

9. The mover of claim 1, wherein said traction wheels have rubber tires.

10. A railcar mover configured for use on rails of a railroad track and comprising:

a frame;

a plurality of rubber-tired traction wheels connected to said frame;

at least one set of retractable rail guide wheels operatively associated with said frame;

a traction enhancing system comprising:

an air nozzle associated with at least one of the rubber-tired or rail guide wheels, mounted to a bracket connected to an associated one of said rail guide wheels for common movement relative to the track between a working and a retracted position;

an outlet of said air nozzle being directed at a selected angle relative to vertical for emitting high pressure air at approximately 120 psi for removing at least one of unwanted debris and moisture from the rail; and a scraper blade associated with said associated rail guide wheel and being located on an opposite side of said rail guide wheel from said air nozzle, and so that said scraper blade contacts debris on the track before the high pressure air from said nozzle, in a direction of travel of the mover.

11. The mover of claim 10 where said nozzle is a Laval nozzle.

12. The mover of claim 10 wherein said scraper blade is provided with a movable backing plate for adjusting blade flexibility.

13. A railcar mover configured for use on a railroad track and having a frame, a plurality of traction wheels, and a traction enhancing system comprising:

an air nozzle associated with the traction wheels, mounted directly or indirectly relative to the frame so that an outlet of said air nozzle is directed at a corresponding rail of the railroad track for emitting high pressure air for removing at least one of unwanted debris and moisture;

a scraper blade associated with said nozzle and mounted relative to said nozzle so that said scraper blade contacts debris on the track before the high pressure air, in a direction of travel of the mover; and at least one set of retractable rail guide wheels, wherein said nozzle and said scraper blade are mounted on one of the same side of the associated rail guide wheel, and opposite sides of the associated rail guide wheel.

* * * * *